US010633948B2

(12) United States Patent
Stair

(10) Patent No.: US 10,633,948 B2
(45) Date of Patent: Apr. 28, 2020

(54) FLOW-ACTIVATED FILL VALVE ASSEMBLY FOR CASED HOLE

(71) Applicant: Halliburton Energy Services, Inc., Houston, TX (US)

(72) Inventor: Todd Anthony Stair, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 58 days.

(21) Appl. No.: 15/542,402

(22) PCT Filed: Feb. 20, 2015

(86) PCT No.: PCT/US2015/016861

§ 371 (c)(1),
(2) Date: Jul. 7, 2017

(87) PCT Pub. No.: WO2016/133541

PCT Pub. Date: Aug. 25, 2016

(65) Prior Publication Data

US 2017/0356270 A1 Dec. 14, 2017

(51) Int. Cl.

| | |
|---|---|
| ***E21B 33/13*** | (2006.01) |
| ***E21B 34/14*** | (2006.01) |
| *E21B 34/00* | (2006.01) |

(52) U.S. Cl.
CPC ..... *E21B 33/13* (2013.01); *E21B 34/14* (2013.01); *E21B 2034/005* (2013.01)

(58) Field of Classification Search
CPC ..... E21B 2034/005
USPC ..... 166/386
See application file for complete search history.

(56) References Cited

U.S. PATENT DOCUMENTS

| | | | | |
|---|---|---|---|---|
| 4,474,241 | A | 10/1984 | Freeman | |
| 5,323,858 | A | 6/1994 | Jones et al. | |
| 2003/0121665 | A1 | 7/2003 | Trott et al. | |
| 2004/0060704 | A1 | 4/2004 | Layton et al. | |
| 2010/0230109 | A1 | 9/2010 | Lake et al. | |
| 2010/0294508 | A1 | 11/2010 | Xu et al. | |
| 2012/0085548 | A1* | 4/2012 | Fleckenstein | E21B 34/063 166/373 |

OTHER PUBLICATIONS

Canadian Application Serial No. 2,973,560; Examiner's Letter; dated May 30, 2018, 3 pages.
International Search Report and Written Opinion for PCT/US2015/016851 dated Sep. 30, 2015.

* cited by examiner

*Primary Examiner* — Taras P Bemko
(74) *Attorney, Agent, or Firm* — Gilliam IP PLLC

(57) ABSTRACT

A differential fill valve assembly for application in float collars or shoes in a well casing can provide a mechanism for releasing a flapper valve by advancing and activating sleeve of the valve assembly. The valve assembly includes a backpressure flapper valve and an activating sleeve slidably disposed within a housing. The activating sleeve initially maintains the flapper valve in an open position. The activating sleeve provides at least one ramp on an inner surface thereof. Fluid flow through the activating sleeve generates a pressure differential, across the activating sleeve that produces a net force on the activating sleeve to drive the activating sleeve downward, releasing the backpressure flapper valve.

20 Claims, 9 Drawing Sheets

FLOW-ACTIVATED FILL VALVE ASSEMBLY FOR CASED HOLE

BACKGROUND

In the oil and gas industry, wellbores are drilled into the Earth's surface in order to access underground reservoirs for the extraction of hydrocarbons. Once a wellbore is drilled, it is often lined with casing or a string of casing sections or lengths, and the casing is then secured into place using cement. In one cementing technique, a cement composition is pumped through the interior of the casing and allowed to flow back toward the surface via the annulus defined between the wellbore wall and the casing. The cement composition within the annulus is then allowed to cure, forming a hardened mass in the annulus. In another cementing technique, commonly referred to as reverse-circulation cementing, the cement composition is pumped through the annulus to the bottom of the wellbore and then back toward the surface via the interior of the casing. Once the cement composition cures within the annulus to form a hardened mass, the casing serves to stabilize the walls of the surrounding subterranean formation to prevent any potential caving into the wellbore. The casing also isolates the various surrounding subterranean formations by preventing the flow or cross-flow of formation fluids via the annulus. The casing further provides a surface to secure pressure control equipment and downhole production equipment, such as a drilling blowout preventer (BOP) or a production packer.

When casing is being run into a wellbore, particularly where deep wells are involved, it is desirable to "float" the casing down to its intended location within the wellbore fluid to relieve some of the strain from the derrick, prior to the time the casing is cemented in the well. It is also desirable to have the casing fill automatically at a predetermined rate to save rig time.

Float valves are one-way valves (i.e., check valves) that can be installed at or near the interior bottom end of a casing string. Once operational, float valves permit fluid (such as mud or cement) to flow down through the inside of the casing while preventing fluids from flowing in the reverse direction back up the inside of the casing. By doing so, float valves prevent cement that is pumped down through the casing, into the shoe track, and up into the annular space from flowing back up through the valves once the cement is in place, an occurrence known as "reverse flow" or "u-tubing." U-tube pressure is created by the differential hydrostatic pressure between the fluid column inside the casing and the fluid column in the annulus. In cases where the cement density is close to drilling mud density, the u-tube pressure may be very small—too small to induce backflow or to be detected at the rig.

Float shoes and float collars have been developed, which permit automatic filling of the casing and incorporate a backpressure valve to prevent cement back flow into the casing after the cementing operation. Certain backpressure valves also permit the option of terminating the filling of the casing at any point in time. During the insertion of casing into the wellbore, a traditional auto-fill, flapper-type float valve is held open by a pin set across a sleeve in the valve assembly bore. As the casing enters the wellbore, the preset spring tension of the flapper valve spring allows controlled filling of the casing to a predetermined differential pressure between the casing interior and the wellbore annulus. Fluid may be circulated through the casing at any time due to the presence of the circulating flapper valve. When it is desired to actuate the backpressure valve to prevent further filling of the casing as it is being run in, or after circulation has been established prior to initiating of the cementing operation for the casing, a weighted tripping ball is dropped, or carried in with the float valve, which breaks the pin holding the sleeve and thereby freeing the flapper valve to close. After cementing has been completed, the released flapper valve prevents cement flow back into the casing from the wellbore annulus. Due to the close operating pressures of the float valve, premature release of the flapper valve can occur. Additionally, the same operating conditions can cause the flapper valve to not release entirely.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1A:
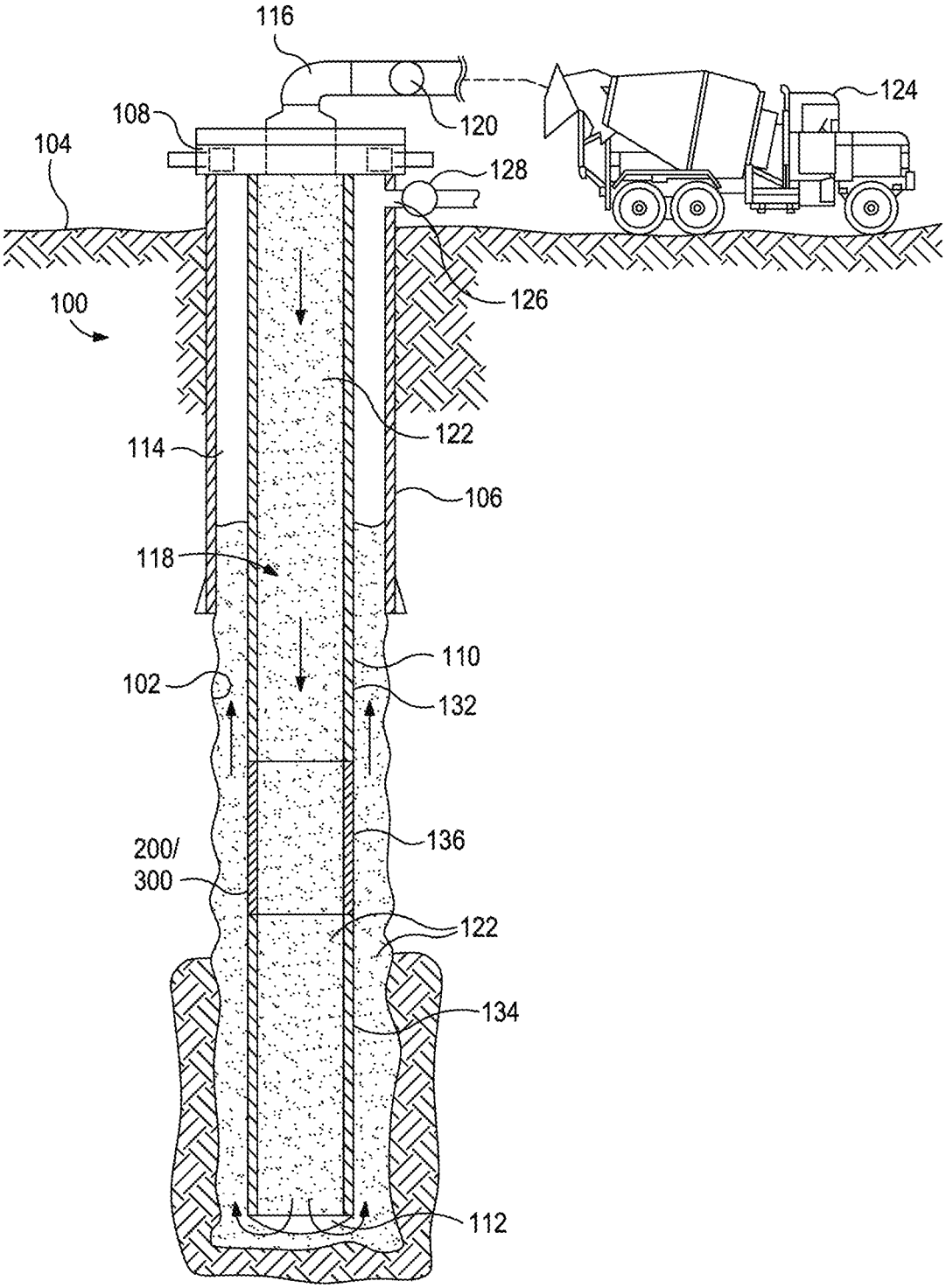
FIG. 1A illustrates a cross-sectional side view of a wellbore system that may employ one or more principles of the present disclosure.

The present disclosure is related to downhole tools and, more particularly, to the operation of downhole tools during wellbore cementing operations.

Traditional fill equipment typically utilizes a match-drilled hole that is pinned with a small diameter brass pin. The pin can be peened and ground flush with the ID of the activation sleeve. These production steps introduce opportunities for errors during assembly, which could produce operational issues. The match-drilled hole and pinning adds considerable time and cost to the assembly of the tool. Moreover, the brass pin may cause premature shifting of the sleeve, or may disable the sleeve from shifting entirely. When a ball lands on the lip of the sleeve, the pin is sheared and the sleeve moves downward. Later, the ball extrudes through the lip. Often, the flow rate of fluid moving past the sleeve does not generate sufficient force to move the sleeve, even when unpinned.

The exemplary differential fill valve assemblies disclosed herein provide a mechanism for positive retention of a backpressure valve in an open mode during run-in of the casing, a mechanism for activating a valve during operation, and a mechanism to maintain the valve in an actuated state during operation.

The differential fill valve assembly of the subject technology includes a backpressure flapper valve disposed within a substantially tubular upper housing, and a lower housing containing a slidably disposed activating sleeve therein.

As casing is run into the well bore, the valve assembly of the subject technology can be located in a float collar or float shoe, or both, in the casing. The activating sleeve holds the backpressure flapper in an open mode, and is itself maintained in position through use of locking rings. When desired, the backpressure valve can be activated by providing fluid flow of particular characteristics, causing a pressure differential to build across upper and lower ramps of the sleeve, which will drive the activating sleeve downwardly. As the activating sleeve moves downward, the backpressure valve is released. An additional lock ring maintains the activating sleeve in its lower position.

Exemplary valve assemblies of the present disclosure allow the activating sleeve to be held in place prior to entry of the weighted tripping ball. The activating sleeve can be held in place without the use of shear pins or other mechanisms that require greater to shear a pin before moving the activating sleeve and releasing the backpressure valve. Mechanisms disclosed herein provide stable securement of the activating sleeve as well as predetermined activation requirements for activating the sleeve and releasing the backpressure valve. The sleeve can be activated by controlling fluid flow, rather than by delivering a solid object (e.g., weighted tripping ball) to obstruct fluid flow. Operational consistency is enhanced by maintaining a high retaining force during circulation and requiring only a low-pressure differential to shift the sleeve as fluid flows through the activating sleeve.

Referring to FIG. 1A, illustrated is a cross-sectional side view of a wellbore system 100 that may employ one or more of the principles of the present disclosure. More particularly, FIG. 1A depicts a wellbore 102 that has been drilled into the Earth's surface 104 and a surface casing 106 secured within the wellbore 102 and extending from the surface 104. A wellhead installation 108 is depicted as being arranged at the surface 104 and a casing string 110 is suspended within the wellbore 102 from the wellhead installation 108. A casing shoe 112 may be attached at the bottom-most portion of the casing string 110, and an annulus 114 is defined between the wellbore 102 and the casing string 110.

As used herein, the term "casing string," as in the casing string 110, may refer to a tubular casing length extending through a wellbore that may include a plurality of tubular casing lengths coupled (e.g., threaded) together to form a continuous tubular conduit of a desired length. It will be appreciated, however, that the casing string 110 may equally refer to a single tubular length or structure, without departing from the scope of the disclosure.

At the surface 104, a feed line 116 may be operably and fluidly coupled to the wellhead installation 108 and in fluid communication with an interior 118 of the casing string 110. The teed line 116 may have a feed valve 120 configured to regulate the flow of cement 122 into the interior 118 of the casing string 110, and the feed line 116 may be fluidly coupled to a source 124 of cement 122. In the depicted embodiment, the source 124 of the cement 122 is a cement truck, but could equally be a cement head, a standalone pump, or any other pumping mechanism known to persons skilled in the art and capable of introducing the cement 122 into the interior 118 of the casing string 110. A return line 126 may also be connected to the wellhead installation 108 and in fluid communication with the annulus 114. In some cases, as illustrated, the return line 126 may include a return valve 128 configured to regulate the flow of fluids returning to the surface 104 via the annulus 114.

In order to secure the casing string 110 within the wellbore 102, cement 122 may be pumped from the source 124 and into the interior 118 of the casing string 110 via the feed line 116. The cement 122 flows to the bottom of the casing string 110 and is diverted at the casing shoe 112 back toward the surface 104 within the annulus 114.

Figure 1B:
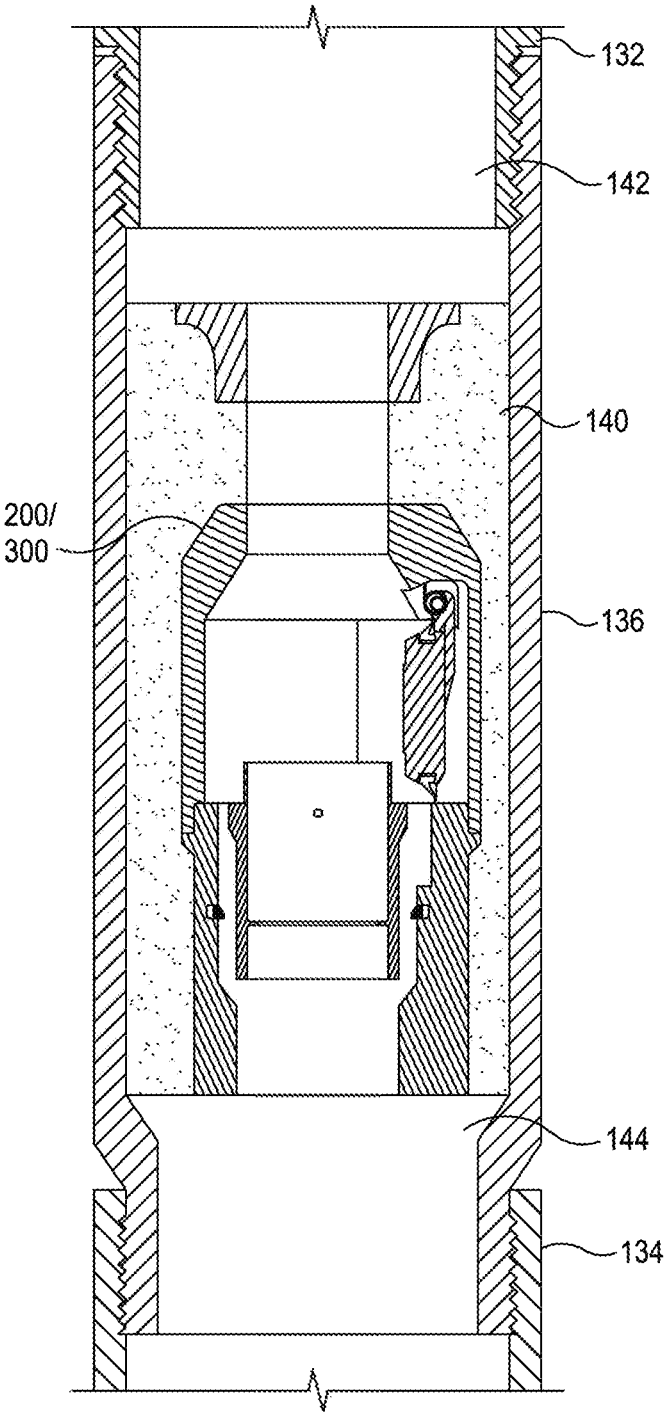
FIG. 1B illustrates a cross-sectional side view of an exemplary differential fill valve assembly, employed in a casing float collar.

Referring to FIG. 1B, a differential fill valve assembly 200 is provided within a float collar 136 of a casing string 110. The float collar 136 can be suspended in a well bore from upper casing 132, having a bore 142. Float collar 136 can include a generally cylindrical tubing section, which can interface with the upper casing 132 by a mating interface (e.g., threads, etc.). A collar 136 can be attached at its lower end to lower casing 134, having a bore 144, by another mating interface (e.g., threads, etc.). The float collar 136 has a substantially uniform inner diameter at an inner surface thereof to hold cement casting 140 in place. The differential fill valve assembly 200 is securely maintained in place, relative to the float collar 136, by the cement casting 140.

Figure 2B:
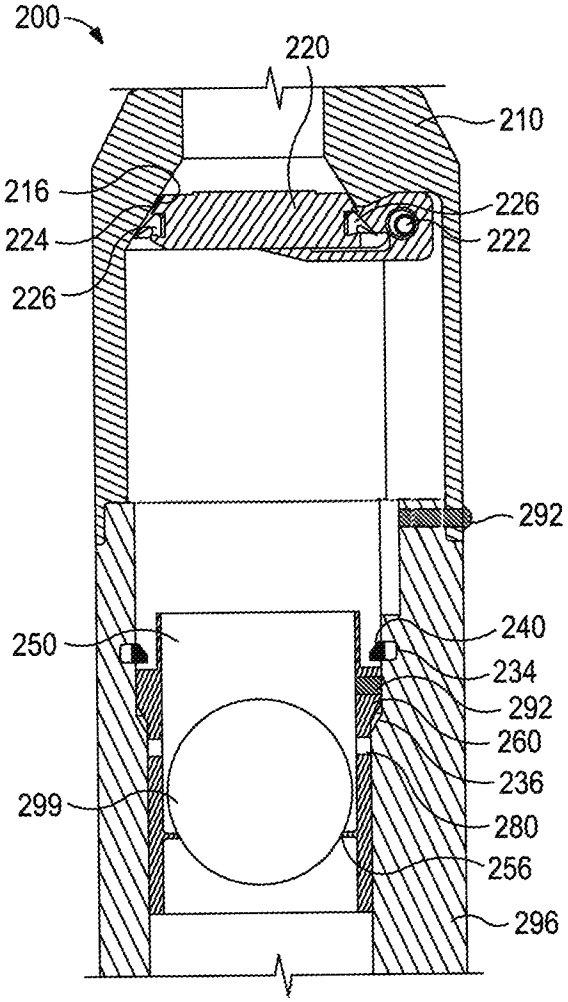
FIGS. 2A-2C illustrate cross-sectional side views of an exemplary differential fill valve assembly, in an unactuated state (FIG. 2A), an actuated state (FIG. 2B), and a reopened state (FIG. 2C).
Figure 2A:
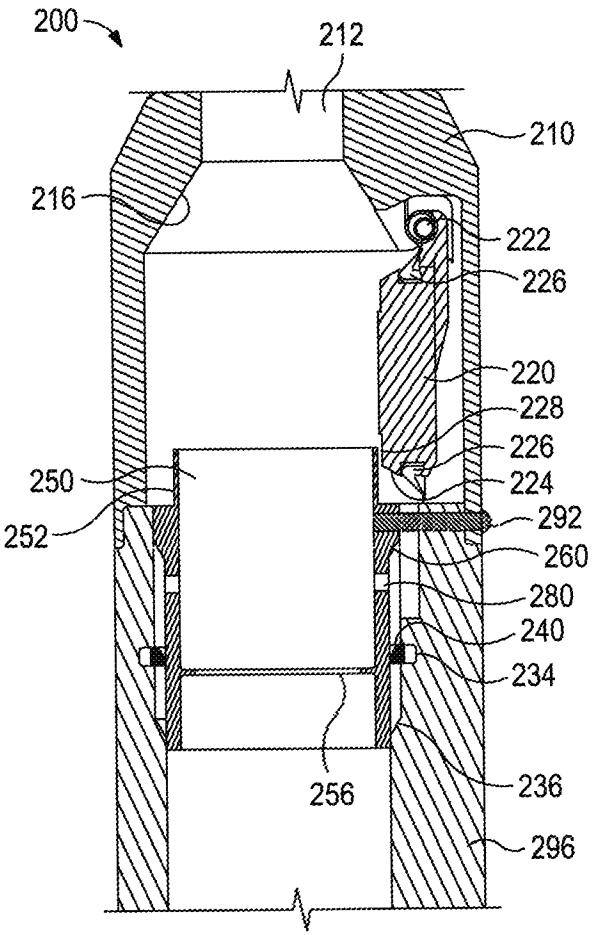
Figure 2C:
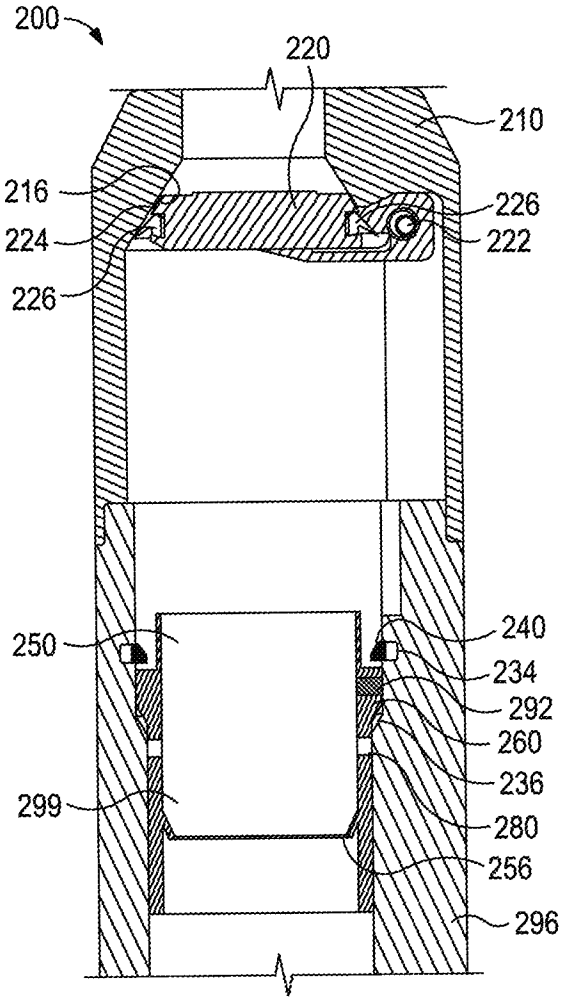

Referring to FIGS. 2A-2C, the valve assembly 200 can include substantially tubular upper housing 210 defining an axial entry bore 212. Below entry bore 212, a frustoconical bore wall 216 can extend radially outward to a larger diameter in a downward direction. The interior of the lower housing 296 also forms a frustoconical surface 236 that tapers from an upper, larger diameter bore wall to a lower, smaller diameter bore wall.

A backpressure flapper 220 is provided on one side of the valve assembly 200. The flapper 220 is pivoted on pin 222, and is biased toward a closed position by a spring, or other biasing mechanism, acting thereupon. One surface of the flapper 220 can include a slight annular undercut surface 228 at its periphery to engage an outer wall 270 of the sleeve 250. An outwardly flaring frustoconical surface 224 extends from the surface 228 to an elastomeric seal 226. The elastomeric seal 226 can extend annularly and provide a flexible lip at an outer extent thereof.

An activating sleeve 250 is slidably contained within a lower housing 296, and can include an annular lip 256 extending from an inner wall thereof. The annular lip 256 can have an inner cross-sectional dimension (e.g., a diameter) that is smaller than an outer cross-sectional dimension (e.g., a diameter) of a weighted tripping ball 299, as described further herein. The annular lip 256 can be further configured to bend, expand, or bow radially outwardly upon application of a force corresponding to a programmed threshold, as described further herein. The exterior of the activating sleeve 250 provides an annular shoulder 260 having a radially flat upper face and a frustoconical lower face. One or more ports 280 extend through the wall of activating sleeve 250 from a radially outer wall 270 of the activating sleeve 250 to a radially inner surface of the activating sleeve 250.

According to one or more embodiments, the activating sleeve 250 can be initially secured to lower housing 296 by one or more shear fasteners 292, which each extend into apertures in the annular shoulder 260. The shear fastener 292 can extend from a first radial side of the annular shoulder 260 through the lower housing 296 and the shoulder 260.

The shear fastener 292 can be peened and ground flush with the inner diameter of the activation sleeve 250.

According to one or more embodiments, a split lock ring 240 surrounds an exterior surface of the activating sleeve 250, and is contained within an annular recess 234. An upper inner frustoconical surface of the lock ring 240 is configured to flare upwardly and radially outwardly. A lower surface can extend in a radial plane.

With continued reference to FIGS. 1A-2C, exemplary operation of the valve assembly 200 is now provided, according to one or more embodiments.

Differential fill float collar 136, as previously noted, is run into the open well bore suspended from casing 132. The well bore is generally filled with fluid such as drilling mud, and the casing is "floated" into the well bore. The casing bore 142 above the differential fill float collar 136 is filled with well bore fluid at a gradual rate, so that the casing 132 above float collar 136 is only partially filled and "floated" into the hole, lessening strain on the derrick. The fluid level above float collar 136 will thus be below that outside the casing. The difference in fluid level is a function of the weight of the drilling fluid and the fillup spring size; the fillup spring may be selected to provide the desired fill rate.

While the casing is being run, the top end of activating sleeve 250 maintains backpressure flapper 220 in an open position. Circulation can be established at any time during the running of the casing without releasing activating sleeve 250.

Referring to FIG. 2B, a weighted tripping ball 299 is dropped down the casing bore 142, where it travels downward until it seats on annular lip 256 in activating sleeve 250. The pressure above ball 299 will build until shear pin 292 shears (if installed), and activating sleeve 250 will travel downward releasing backpressure flapper 220. Activating sleeve 250 can be prevented from rotating by the shear fastener 292.

As shown in FIG. 2C, after the activating sleeve 250 reaches the full extent of its travel, ball 299 can extended past the annular lip 256 and be pumped out of the float collar 136 to the bottom of the well bore. Ports 280 in the wall of activating sleeve 250 permit any fluid trapped near the annular shoulder 260 of the activating sleeve 250 to escape when the activating sleeve 250 moves down. The activating sleeve 250 is prevented from moving back to its original position by the lock ring 240; as the shoulder 260 on activating sleeve 250 contacts the frustoconical upper face on the lock ring 240, the lock ring 240 is forced apart and over the shoulder 260 so that when differential pressure is released (as when ball 299 leaves the float collar 136), the radially flat lower face of the lock ring 240 will engage the shoulder 260 of the activating sleeve 250.

As the cementing operation is performed, the released backpressure flapper 220 is able to control any back flow of cement up into casing bore 142, as the elastomeric seal 226 seats on the annular surface 216 of the upper housing 210 as the hydrostatic pressure in the casing bore 144 and the force of the spring 222 urges the backpressure flapper 220 into a closed position. At the resumption of cement pumping, pump pressure in the casing bore 142 overcomes the spring force and hydrostatic pressure below the float collar 136, and the backpressure flapper 220 reopens.

After the cementing operation is completed, the interior components of the float collar 136 can be drilled out by means known in the art to provide an open casing bore to the bottom of the casing.

Referring now to FIGS. 3A-3E, with continued reference to FIGS. 1A-1B, another exemplary valve assembly 300 can include substantially tubular upper housing 310 defining an axial entry bore 312. Below entry bore 312, a frustoconical bore wall 316 can extend radially outward to a larger diameter in a downward direction. The interior of the lower housing 396 also forms a frustoconical surface 336 that tapers from an upper, larger diameter bore wall to a lower, smaller diameter bore wall.

A backpressure flapper 320 may be provided on one side of the valve assembly 300. The flapper 320 may be pivotable on a pin 322 and biased toward a closed position by a torsion spring, or other biasing mechanism, acting thereupon. One surface of the flapper 320 can include a slight annular undercut surface 328 at its periphery to engage an outer wall 370 of the sleeve 350. An outwardly flaring frustoconical surface 324 extends from the surface 328 to an elastomeric seal 326. The elastomeric seal 326 can extend annularly and provide a flexible lip at an outer extent thereof.

Figure 3A:
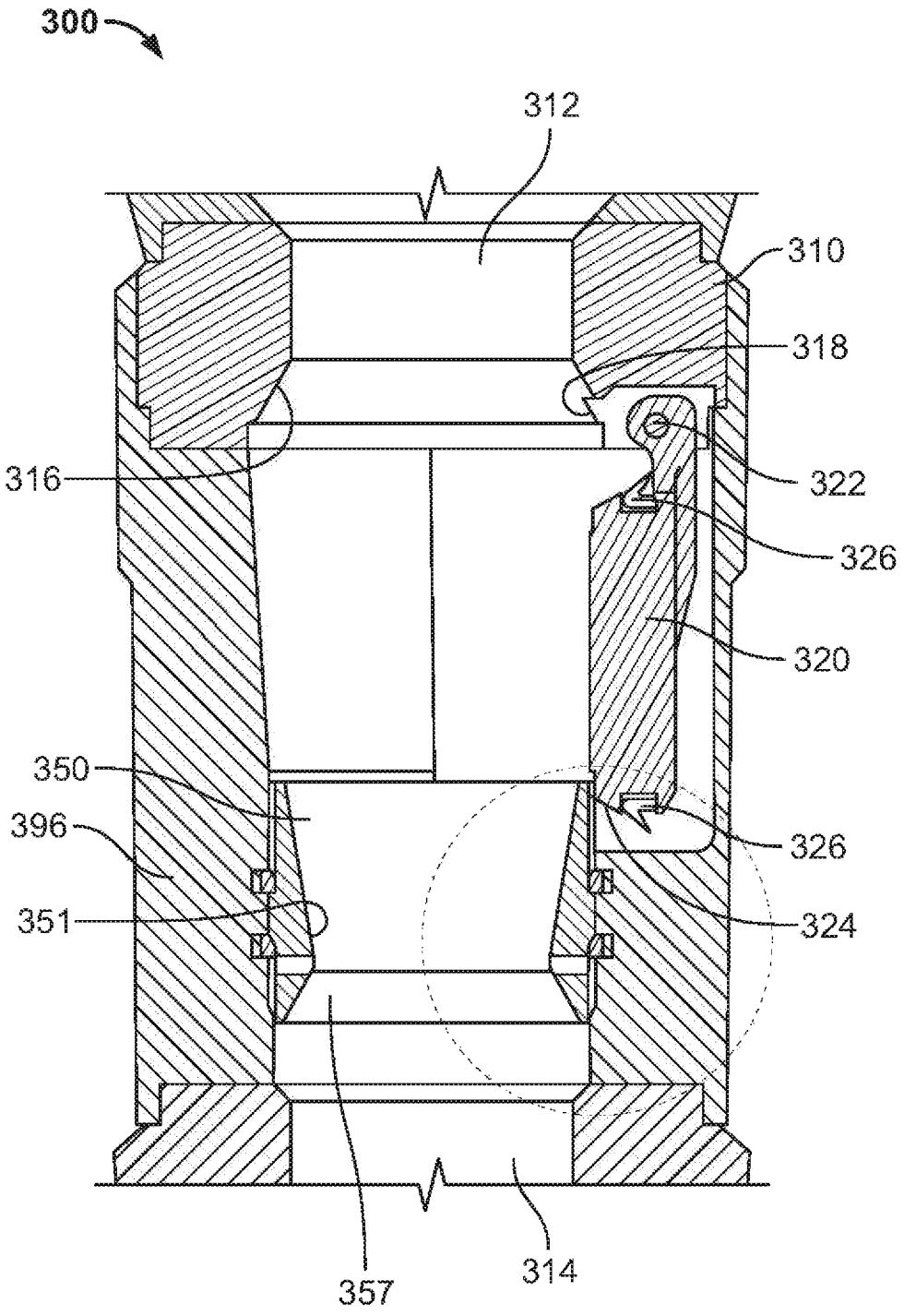
FIG. 3A illustrates a cross-sectional side view of an exemplary differential fill valve assembly in an unactuated state.
Figure 3B:
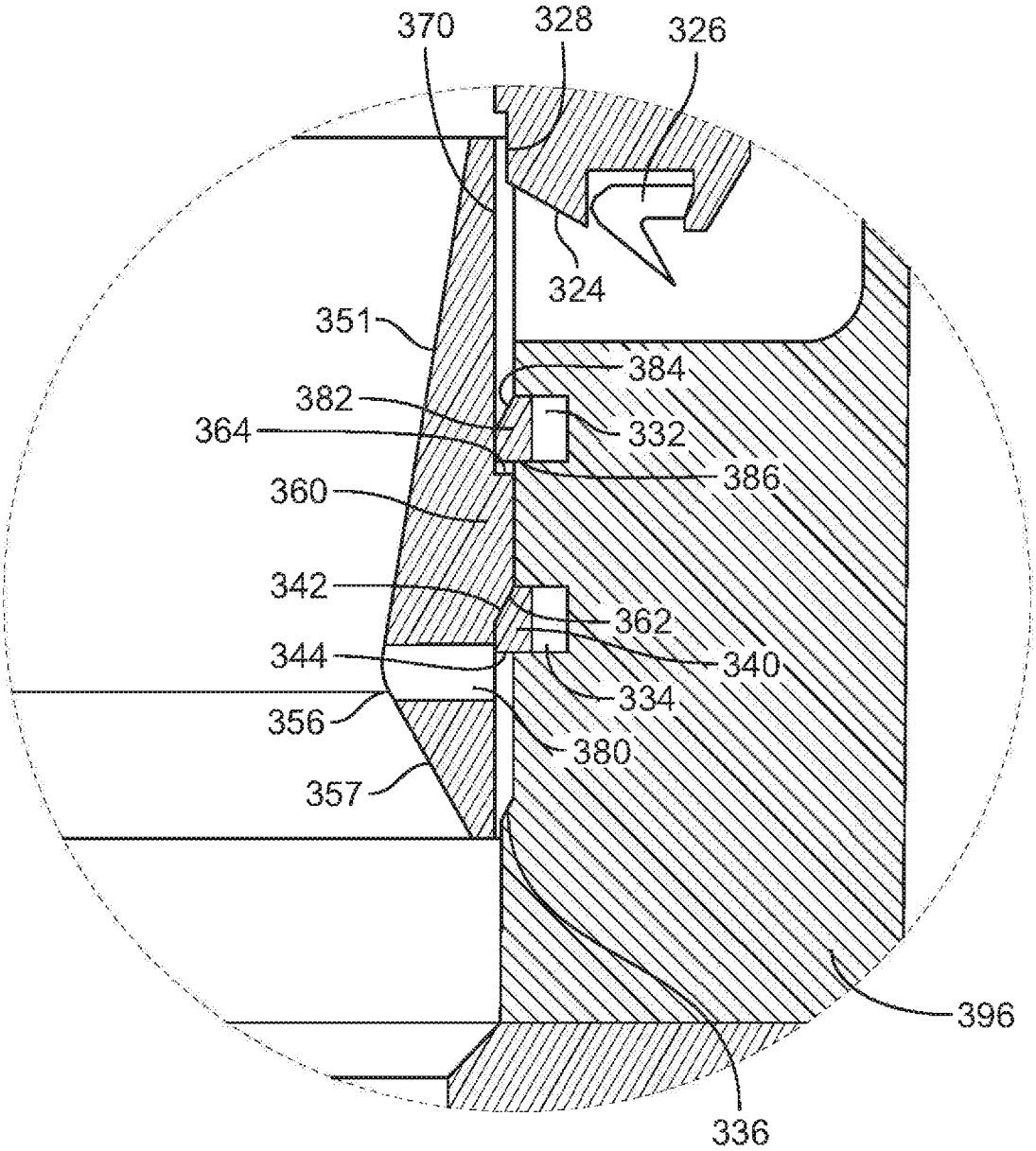
FIG. 3B illustrates an enlarged portion of the differential fill value assembly of Ha 3A as indicated by the dashed circle in FIG. 3A.
Figure 3C:
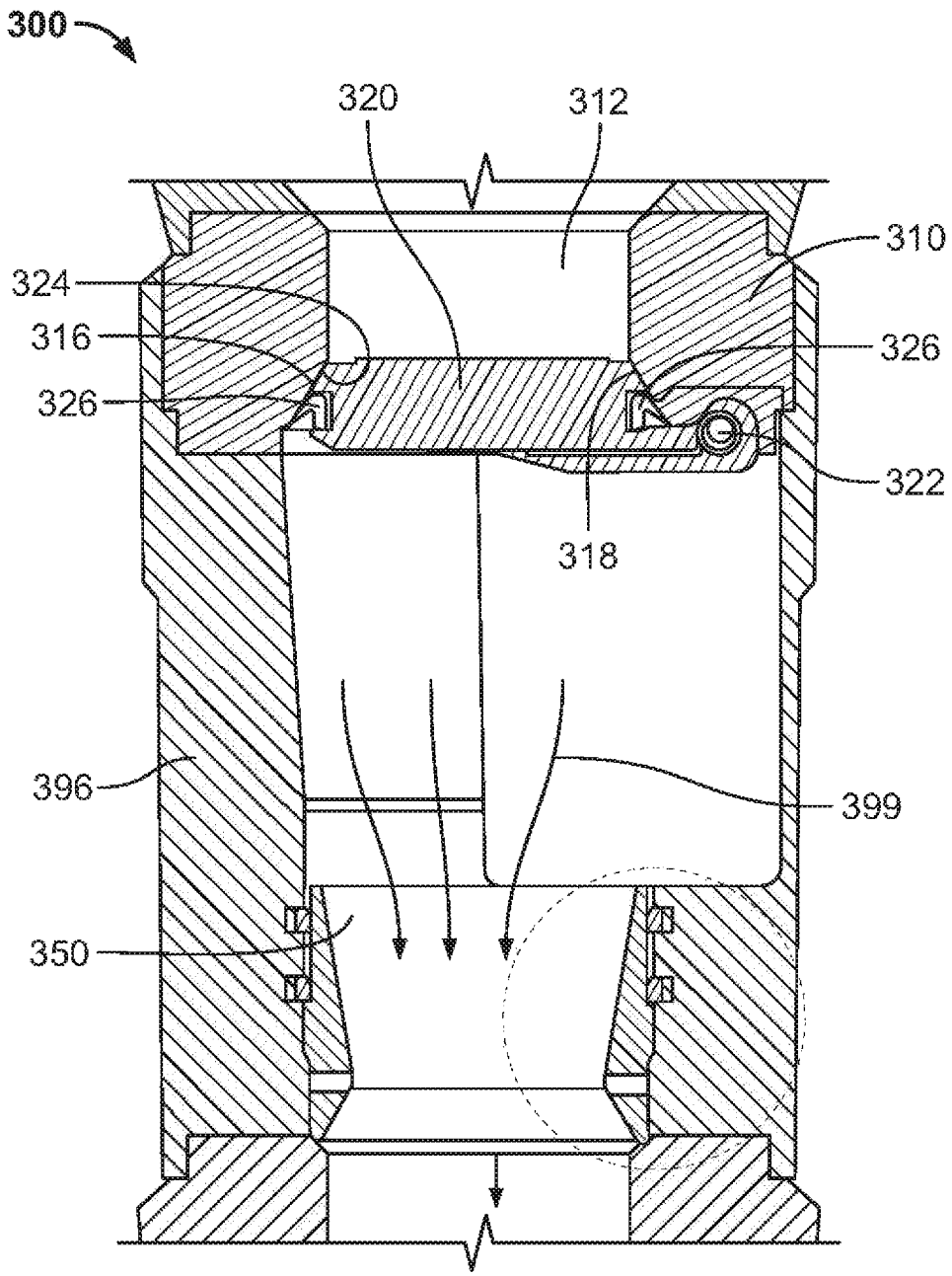
FIG. 3C illustrates a cross-sectional side view of the exemplary differential fill value assembly of FIG. 3A in an actuated state.

As shown in FIGS. 3A, 3B, 3C, and 3D, an activating sleeve 350 may be slidably contained within a lower housing 396, and can include an annular peak 356 extending from an inner wall thereof. According to one or more embodiments, as best shown in FIG. 3E, the annular peak 356 can define the minimum inner cross-sectional dimension (e.g., a diameter) of the activating sleeve 350. The annular peak 356 can separate an upper section of the activating sleeve 350 having an upper ramp 351 from a lower section of the activating sleeve 350 having a lower ramp 357.

According to one or more embodiments, the upper ramp 351 and/or the lower ramp 357 can define tapering or frustoconical shapes. The upper ramp 351 can extend longitudinally and radially inward from an upper end of the activating sleeve 350 to the annular peak 356. The lower ramp 357 can extend longitudinally and radially inward from the lower end of the activating sleeve 350 to the annular peak 356. According to one or more embodiments, the upper ramp 351 and/or the lower ramp 357 can define one or more types of surface contours. For example, with respect to an ideal frustoconical surface, the upper ramp 351 and/or the lower ramp 357 can be flat, convex, concave, or undulating. In other embodiments, the transition from the upper ramp 351 to the lower ramp 357 can be smooth or abrupt. Moreover, in at least one embodiment, more than one annular peak 356 can be provided within the activation sleeve 350.

The upper ramp 351 may form an upper angle 353 (FIG. 3E) with respect to a longitudinal or central axis of the activating sleeve 350. Moreover, the lower ramp 357 may form a lower angle 359 (FIG. 3E) with respect to the longitudinal axis. The upper ramp 351 may exhibit an upper longitudinal height 352 extending from a first side of the activating sleeve 350 to the annular peak 356. Similarly, the lower ramp 357 may exhibit a lower longitudinal height 358 extending from a second side of the activating sleeve 350 to the annular peak 356. According to one or more embodiments, the upper ramp 351 and a lower ramp 357 can extend radially inwardly by a radial distance 355.

In some embodiments, the upper ramp 351 and the lower ramp 357 may define symmetrical or asymmetrical inner contours of the activating sleeve 350. For example, the upper longitudinal height 352 can be greater than, equal to, or less than the lower longitudinal height 358. By further example, the upper angle 353 can be smaller than, equal to, or greater than the lower angle 359.

Because of the inwardly tapering annular peak 356, flow of a fluid through the activating sleeve 350 can produce a pressure differential on opposite sides of the annular peak 356. A greater pressure on the side of the upper ramp 351 and a lower pressure on the side of the lower ramp 357 can result in a net force that provides a downward thrust. As will be appreciated, the relative geometries of the upper ramp 351 and the lower ramp 357 can produce drag (e.g., form drag) as the fluid flows through the activating sleeve 350. The magnitude and direction of the net force on the activating sleeve 350 can be a product of the fluid flow and/or the shape of the activating sleeve 350. For example, as flow velocity of a fluid is increased, a magnitude of a net force on the activating sleeve 350 can also increase.

More particularly, for a given maximum cross-sectional dimension 361 of the upper ramp 351 (e.g., at an inlet 349) and a given minimum cross-sectional dimension 363 of the upper ramp 351 (e.g., at the annular peak 356), a net force, F, can be expressed as:

$$F = \frac{\Delta P}{A_{eff}}$$

In the above equation, ΔP is the difference in pressure between the inlet 349 and the annular peak 356, which can be expressed as:

$$\Delta P = \frac{\rho}{2}(V_2^2 - V_1^2)$$

where ρ is the density of the fluid, $V_2$ is the fluid velocity at the annular peak 356, and $V_1$ is the fluid velocity at the inlet 349. $A_{eff}$ is the difference in cross-sectional area between the inlet 349 and the annular peak 356, which can be expressed as:

$$A_{eff} = A_2 - A_1$$

where $A_2$ is the cross-sectional area at the annular peak 356, and $A_1$ is the cross-sectional area at the inlet 349. It is noted that the fluid velocities can be expressed as:

$$V_1 = \frac{Q}{A_1}$$

$$V_2 = \frac{Q}{A_2}$$

One or more ports 380 may be defined in and otherwise extend through the wall of activating sleeve 350 from a radially outer surface of the activating sleeve 350 to a radially inner surface of the activating sleeve 350. The activating sleeve 350 can be formed from one or more of a variety of materials, including brass, aluminum, steel, composite materials, elastomers, and thermoplastic or thermoset polymers. As will be appreciated, selection of the material for the activating sleeve 350 can facilitate drilling through the valve assembly 300 at the completion of an operation.

The exterior of the activating sleeve 350 provides an annular shoulder 360 with an upper face 364 in a radial plane. For example, the upper face 364 can face axially toward the axial entry bore 312 at any point thereon. Alternatively, the upper face 364 can be frustoconical by flaring upwardly and radially outwardly. Other shapes of the upper face 364 are contemplated, such as concave and/or convex contoured surfaces. The upper face 364 can be configured to securely engage opposing and/or complementary surfaces on an upper side of the shoulder 360.

The annular shoulder 360 can further have a frustoconical lower face 362. For example, the lower face 362 can face radially outwardly and downwardly (i.e., toward the axial exit bore 314) at any point thereon. By further example, the lower face 362 can form an oblique angle relative to a longitudinal axis of the valve assembly 300. Such an angle can be selected to determine, at least in part, the force required to shift the activating sleeve 350 past a lower lock ring 340. For example, the angle can be between 10° and 80°. An exemplary lower face 362 can form an angle of 27°. Greater angles can result in a greater force being required. Smaller angles can result in a smaller force being required. The required force can be significant enough to avoid premature movement of the activating sleeve 350, yet still be less than a force required to both shear a pin and move an activating sleeve. Other shapes of the lower face 362 are contemplated, such as concave and/or convex contoured surfaces. The lower face 362 can be configured to engage and/or separate structures providing opposing and/or complementary surfaces on a lower side of the shoulder 360.

An upper split lock ring 382 may surround an exterior surface of the activating sleeve 350, and may be contained within an annular recess 332. The upper split lock ring 382 can be formed as a circumferentially discontinuous ring that can expand to increase an opening therethrough. Other radial locking mechanisms can be used to controllably retain the activating sleeve 350. For example, one or more retractable protrusions, biased radially inwardly, can individually engage the shoulder 360. By further example, a radial locking mechanism can be provided to receive the activating sleeve 350 from the entry bore 312 when a force by the activating sleeve 350 causes elastic or plastic deformation of such a radial locking mechanism. Other locking methods could include collet mechanisms, j-slots, snap-fit, interference fit, or friction alone. The upper split lock ring 382 can be formed from one or more of a variety of materials, including brass, aluminum, steel, composite materials, elastomers, and thermoplastic or thermoset polymers. Material selection for the upper split lock ring 382 can provide predetermined retention of the shoulder 360 of the activating sleeve 350 up to selected force limits, beyond which the upper split lock ring 382 can be elastically or plastically deformed to allow passage of the shoulder 360. Material selection for the upper split lock ring 382 can facilitate drilling of the components at the completion of an operation.

An upper inner frustoconical surface 384 of the upper lock ring 382 flares radially upward and outward. For example, the upper surface 384 can face radially inward and upward (i.e., toward the axial entry bore 312) at any point thereon. A lower surface 386 can extend in a radial plane. For example, the lower surface 386 can face axially toward the axial exit bore 314 at any point thereon. The upper split lock ring 382 can have an inner cross-sectional dimension (e.g., a diameter) that is smaller than an outer cross-sectional dimension (e.g., a diameter) of the shoulder 360 of the activating sleeve 350.

Before the activating sleeve 350 moves downwardly, the upper split lock ring 382 can prevent the activating sleeve 350 from moving upwardly by engaging the shoulder 360. In such embodiments, no shear fastener may be required to prevent the activating sleeve 350 from moving upwardly. For example, as shown in FIG. 3B, the upper lock ring 382 can be biased to contract radially inwardly such that the lower surface 386 of the upper lock ring 382 can contact and engage the upper face 364 of the shoulder 360. The surface contours of the lower surface 386 and the upper face 364 can be such that an upward force applied by the upper face 364 to the lower surface 386 does not tend to cause radial expansion of the upper lock ring 382.

A lower split lock ring 340 may surround an exterior surface of the activating sleeve 350, and may be contained within an annular recess 334. An upper inner frustoconical surface 342 of the lower lock ring 340 flares radially upwardly and outwardly. For example, the upper surface 342 can face radially inwardly and upwardly (i.e., toward the axial entry bore 312) at any point thereon. By further example, the upper surface 342 can form an oblique angle relative to a longitudinal axis of the valve assembly 300. Such an angle can be selected to determine, at least in part, the force required to shift the activating sleeve 350 past the lower lock ring 340. An angle formed by the upper surface 342 relative to a longitudinal axis can be equal to an angle formed by the lower face 362 relative to the same longitudinal axis. A lower surface 344 can extend in a radial plane. For example, the lower surface 344 can face axially toward the axial exit bore 314 at any point thereon. The lower split lock ring 340 can have an inner cross-sectional dimension (e.g., a diameter) that is smaller than an outer cross-sectional dimension (e.g., a diameter) of the shoulder 360 of the activating sleeve 350.

The lower lock ring 340 and the shoulder 360 can define a predetermined threshold for a minimum force required to achieve passage of the shoulder 360 past the lower lock ring 340. The inner shape of the activating sleeve 350 (e.g., the upper ramp 351 and/or the lower ramp 357) can, at least in part, define net forces providing thrust to the activating sleeve 350 for a given flow characteristic (e.g., flow rate, viscosity, composition) of the fluid flowing through the activating sleeve 350. Accordingly, the system 300 can be optimized to actuate the activating sleeve 350 and release the flapper 320 upon occurrence of one or more predetermined flow characteristics of the fluid. Furthermore, flow characteristics can be controlled during operation to produce the requisite characteristics to actuate the activating sleeve 350 and release the flapper 320. For example, during operation, a flow rate of a fluid (e.g. cement) can be controlled such that, at a desired time, the flow rate is sufficient to actuate the activating sleeve 350 and release the flapper 320.

When the activating sleeve 350 moves downwardly, the lower face 362 is configured to apply a force against the upper surface 342 of the lower split lock ring 340. The lower split lock ring 340 can be discontinuous or otherwise sufficiently flexible to move radially outwardly into the annular recess 334 and allow passage of the shoulder 360. The lower split lock ring 340 can be formed as a circumferentially discontinuous ring that can expand to increase an opening there through. Other radial locking mechanisms can be used to controllably retain the activating sleeve 350. For example, one or more retractable protrusions, biased radially inwardly, can individually engage corresponding portions of the shoulder 360. By further example, a radial locking mechanism can be provided to retain the activating sleeve 350 until a force by the activating sleeve 350 causes elastic or plastic deformation of such a radial locking mechanism. Other locking methods could include collet mechanisms, j-slots, snap-fit, interference fit, or friction alone. The lower split lock ring 340 can be formed from one or more of a variety of materials, including brass, aluminum, steel, composite materials, elastomers, and thermoplastic or thermoset polymers. Material selection for the lower split lock ring 340 can provide predetermined retention of the shoulder 360 of the activating sleeve 350 up to selected force limits, beyond which the lower split lock ring 340 can be elastically or plastically deformed to allow passage of the shoulder 360. Material selection for the lower split lock ring 340 can facilitate drilling of the components at the completion of an operation. The lower face 362 and the upper surface 342 can provide complementary surface contours to maximize an amount of surface contact between the lower face 362 and the upper surface 342.

Figure 3D:
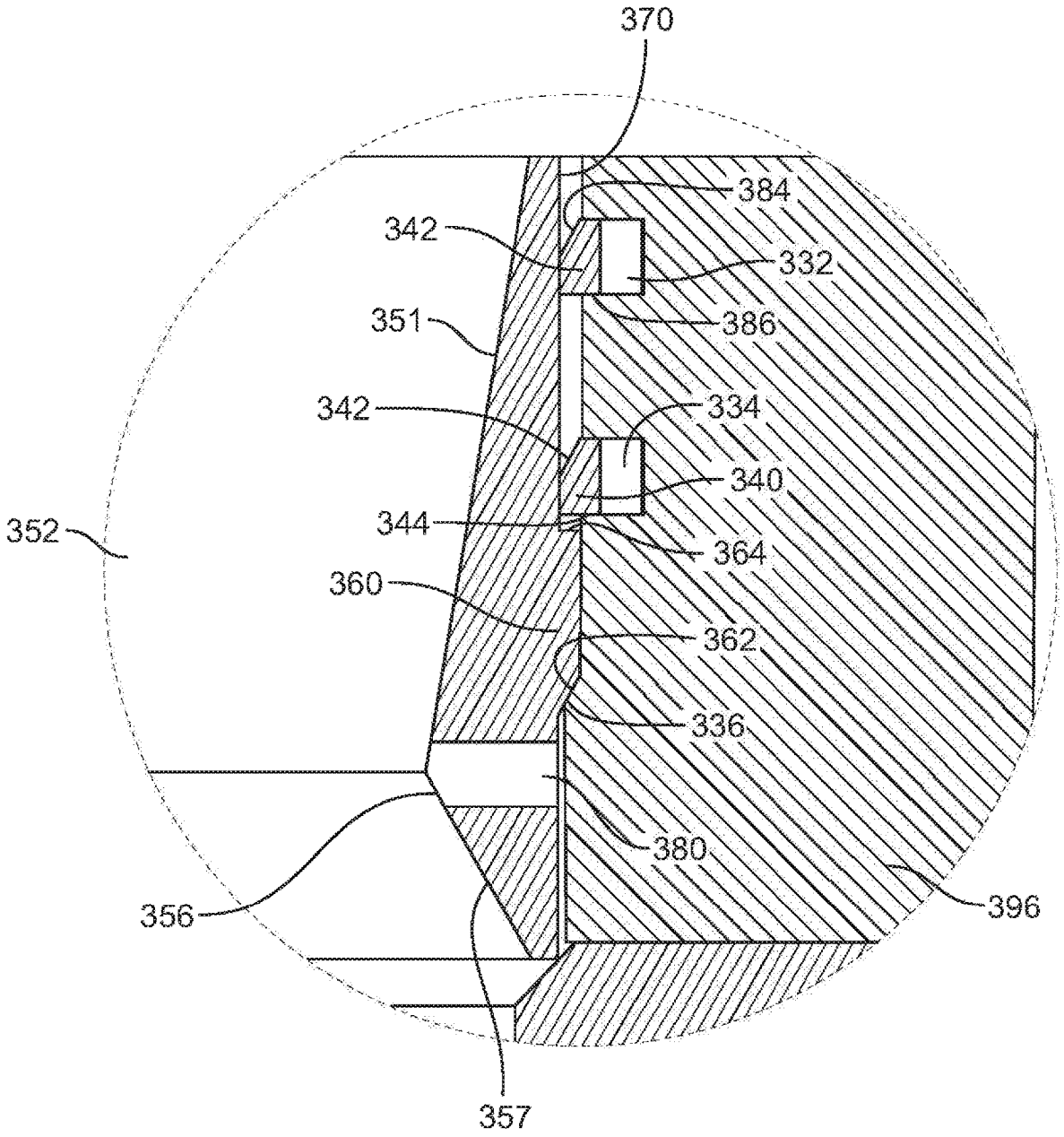
FIG. 3D illustrates an enlarged portion of the differential fill value assembly of FIG. 3C as indicated by the dashed circle in FIG. 3C.
Figure 3E:
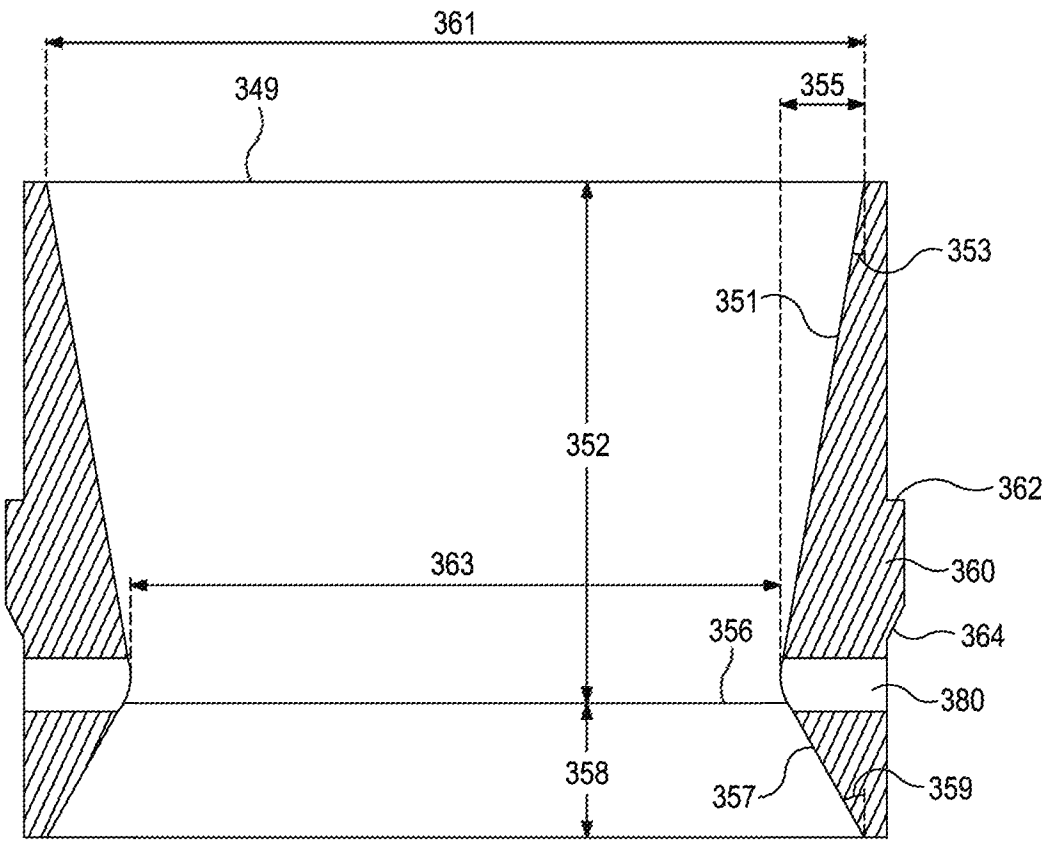
FIG. 3E illustrates a cross-sectional side view of an exemplary activating sleeve for a differential fill valve assembly.

After the activating sleeve 350 moves downwardly, the lower split lock ring 340 can prevent the activating sleeve 350 from moving upwardly again by engaging the shoulder 360, For example, as shown in FIG. 3D, the lower face 362 of the shoulder 360 can settle upon the frustoconical surface 336 of the lower housing 396. The lower face 362 and the frustoconical surface 336 can provide complementary surface contours to maximize an amount of surface contact between the lower face 362 and the frustoconical surface 336. After the activating sleeve 350 complete such downward travel, the lower lock ring 340 can contract radially inwardly such that the lower surface 344 of the lower lock ring 340 can contact and engage the upper face 364 of the shoulder 360. The surface contours of the lower surface 344 and the upper face 364 can be such that an upward force applied by the upper face 364 to the lower surface 344 does not tend to cause radial expansion of the lower lock ring 340.

Referring now to FIGS. 1A-1B and 3A-3D, exemplary operation of the valve assembly 300 is now provided, according to one or more embodiments.

Differential fill float collar 136, as previously noted, is run into the open well bore suspended from casing 132. The well bore is generally filled with fluid such as drilling mud, and the casing is "floated" into the well bore. The casing bore 142 above the differential fill float collar 136 is filled with well bore fluid at a gradual rate, so that the casing 132 above float collar 136 is only partially filled and "floated" into the hole, lessening strain on the derrick. The fluid level above float collar 136 will thus be below that outside the casing. The difference in fluid level is a function of the weight of the drilling fluid and the fillup spring size; the fillup spring may be selected to provide the desired fill rate.

While the casing is being run, the top end of activating sleeve 350 maintains backpressure flapper 320 in an open position. Circulation can be established at any time during the running of the casing without releasing activating sleeve 350.

A flow 399 of a fluid through the activating sleeve 350 creates pressure conditions that result in a net downward force on the activating sleeve 350. For example, at certain flow rates, the pressure along the upper ramp 251 will be greater than a pressure along the lower ramp 257. This pressure differential will build until the activating sleeve 350 travels downward, releasing backpressure flapper 320. According to one or more embodiments, the only force required to allow travel of the activating sleeve 350 is the force required to actuate the lower lock ring 340. According to one or more embodiments, the activating sleeve 350 is not secured to the lower housing 396 or any portion of the valve assembly 300. Rather, the only limits on axial movement of the activating sleeve 350 are imposed by the upper lock ring 382 and a lower lock ring 340.

Ports 380 in the wall of activating sleeve 350 permit any fluid near the annular shoulder 360 of the activating sleeve 350 to escape when the activating sleeve 350 moves down. The activating sleeve 350 is prevented from moving back to its original position by the lock ring 340. As the shoulder 360 of activating sleeve 350 contacts the frustoconical upper face 342 on the lock ring 340, the lock ring 340 is forced apart and over the shoulder 360. When differential pressure is released, the lower face 344 of the lock ring 340 will engage corresponding portions of the shoulder 360 of the activating sleeve 350.

As the cementing operation is performed, the released backpressure flapper 320 is able to control any back flow of cement up into casing bore 142, as the elastomeric seal 326 seats on the annular surface 316 of the upper housing 310 as the hydrostatic pressure in the casing bore 144 and the force of the spring 322 urges the backpressure flapper 320 into a closed position. At the resumption of cement pumping, pump pressure in the casing bore 142 overcomes the spring force and hydrostatic pressure below the float collar 136, and the backpressure flapper 320 reopens.

After the cementing operation is completed, the interior components of the float collar 136 can be drilled out by means known in the art to provide an open casing bore to the bottom of the casing.

According to one or more embodiments, the valve assembly 300 of the present disclosure can be used in one or more of a variety of applications for a wellbore operation. According to one or more embodiments, the valve assembly 300 can be operated to selectively divert flow or a portion of flow by opening an alternate flow path upon achievement of a predetermined flow rate through the activating sleeve 350. Activation of an alternate flow path can relieve pressure or flow rate through the activating sleeve 350.

According to one or more embodiments, the valve assembly 300 can be operated to open flow ports into an annulus. For example, operation of the valve assembly 300 can actuate a stage-cementing tool and/or a differential valve ("DV") tool to cement multiple sections behind the casing string, or to cement a critical long section in multiple stages.

According to one or more embodiments, the valve assembly 300 can be operated to initiate tool actuation. For example, operation of the valve assembly 300 can result in actuation of a packer, a valve, etc.

Embodiments disclosed herein include:

A. An assembly, including: a downhole tool biased to transition from a restrained position to a released position; an activating sleeve retaining the downhole tool in the restrained position, the activating sleeve providing, on an inner surface, an upper ramp and a lower ramp configured to generate a pressure drop across an axial length of the activating sleeve when a fluid flows through the activating sleeve.

B. A tool string, including: a casing; a float collar within the casing; a valve assembly within the float collar, the valve assembly including: a flapper valve biased to move from a restrained position to a released position to cover an entry bore; an activating sleeve retaining the flapper valve in the restrained position, the activating sleeve providing, on an inner surface, an upper ramp and a lower ramp configured to generate a pressure drop across an axial length of the activating sleeve when a fluid flows through the activating sleeve.

C. A method, including: providing a valve assembly with an activating sleeve retaining a flapper valve in a restrained position; while fluid flows through the activating sleeve, generating a pressure drop, across the activating sleeve, sufficient to advance the activating sleeve toward an exit bore; and releasing the flapper valve to move from a restrained position to a released position to cover an entry bore.

Each of embodiments A, B, and C may have one or more of the following additional elements in any combination:

Element 1: the activating sleeve can provide an annular peak, between the upper ramp and the lower ramp, defining a minimum inner cross-sectional dimension of the activating sleeve. Element 2: the upper ramp can taper from a maximum upper cross-sectional dimension at a first end of the activating sleeve to the minimum inner cross-sectional dimension at the annular peak; and wherein the lower ramp tapers from the maximum lower cross-sectional dimension at a second end of the activating sleeve to the minimum inner cross-sectional dimension at the annular peak. Element 3: a longitudinal height of the upper ramp can be greater than a longitudinal height of the lower ramp. Element 4: a first angle formed by the upper ramp and a longitudinal axis of the activating sleeve can be smaller than a second angle formed by the lower ramp and the longitudinal axis. Element 5: the activating sleeve can include a shoulder and a lower radial lock mechanism, between the shoulder and an exit bore; can be configured to prevent movement of the shoulder toward the exit bore and past the lower radial lock mechanism until a force threshold is exceeded. Element 6: the force threshold can be determined at least in part by a flow characteristic of the fluid. Element 7: the flow characteristic can be a flow rate. Element 8: generating a pressure drop can include passing fluid past an upper ramp and a lower ramp of the activating sleeve. Element 9: the advancing can include moving the shoulder toward the exit bore and past a lower radial lock mechanism. Element 10: generating the pressure drop can include controlling the flow of the fluid to generate a net force on the activating sleeve that exceeds a threshold required to move a shoulder of the activating sleeve passed a lower lock mechanism.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items; and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. An assembly, comprising:

a downhole tool biased to transition from a restrained position to a released position;

an activating sleeve configured to retain the downhole tool in the restrained position when the activating sleeve is maintained in an original position and to move from the original position to release the downhole tool from the restrained position, the activating sleeve comprising an inner surface comprising an upper ramp and a lower ramp that cooperatively generate a pressure drop across an axial length of the activating sleeve when a fluid flows through the activating sleeve; and a locking mechanism configured to maintain the activating sleeve in the original position until a force exerted by the activating sleeve on the locking mechanism exceeds a force threshold, the locking mechanism configured to allow the activating sleeve to move away from the original position when the force exerted on the locking mechanism exceeds the force threshold;

wherein the force exerted by the activating sleeve on the locking mechanism is generated by the pressure drop that is generated while the fluid flows through the activating sleeve.

2. The assembly of claim 1, wherein the upper ramp and the lower ramp cooperatively define an annular peak that defines a minimum inner cross-sectional dimension of the activating sleeve.

3. The assembly of claim 2, wherein the upper ramp tapers from a maximum upper cross-sectional dimension at a first end of the activating sleeve to the minimum inner cross-sectional dimension at the annular peak, and wherein the lower ramp tapers from a maximum lower cross-sectional dimension at a second end of the activating sleeve to the minimum inner cross-sectional dimension at the annular peak.

4. The assembly of claim 1, wherein a longitudinal height of the upper ramp is greater than a longitudinal height of the lower ramp.

5. The assembly of claim 1, wherein the upper ramp forms a first angle with respect to a longitudinal axis of the activating sleeve and the lower ramp forms a second angle with respect to the longitudinal axis, and wherein the first angle is smaller than the second angle.

6. The assembly of claim 1, wherein the locking mechanism comprises a lower radial lock mechanism, and wherein the activating sleeve comprises a shoulder and having the lower radial lock mechanism positioned axially between the shoulder and an exit bore, the lower radial lock mechanism preventing movement of the shoulder toward the exit bore until the force threshold is exceeded.

7. The assembly of claim 6, wherein the force threshold is determined at least in part by a flow characteristic of the fluid.

8. The assembly of claim 7, wherein the flow characteristic is a flow rate of the fluid.

9. A tool string, comprising:

a casing;

a float collar positioned within the casing;

a valve assembly positioned within the float collar and including:

a flapper valve biased to move from a restrained position to a released position to cover an entry bore;

an activating sleeve configured to retain the flapper valve in the restrained position when the activating sleeve is maintained in an original position and to move from the original position to release the flapper value from the restrained position, the activating sleeve comprising an inner surface comprising an upper ramp and a lower ramp that cooperatively generate a pressure drop across an axial length of the activating sleeve when a fluid flows through the activating sleeve;

a locking mechanism configured to maintain the activating sleeve in the original position until a force exerted by the activating sleeve on the locking mechanism exceeds a force threshold, the locking mechanism configured to allow the activating sleeve to move away from the original position when the force exerted on the locking mechanism exceeds the force threshold;

wherein the force exerted by the activating sleeve on the locking mechanism is generated by the pressure drop that is generated while fluid flows through the activating sleeve.

10. The tool string of claim 9, wherein the upper ramp and the lower ramp cooperatively define an annular peak that defines a minimum inner cross-sectional dimension of the activating sleeve.

11. The tool string of claim 10, wherein the upper ramp tapers from a maximum upper cross-sectional dimension at a first end of the activating sleeve to the minimum inner cross-sectional dimension at the annular peak, and wherein the lower ramp tapers from a maximum lower cross-sectional dimension at a second end of the activating sleeve to the minimum inner cross-sectional dimension at the annular peak.

12. The tool string of claim 9, wherein a longitudinal height of the upper ramp is greater than a longitudinal height of the lower ramp.

13. The tool string of claim 9, wherein the upper ramp forms a first angle with respect to a longitudinal axis of the activating sleeve and the lower ramp forms a second angle with respect to the longitudinal axis, and wherein the first angle is smaller than the second angle.

14. The tool string of claim 9, wherein the locking mechanism comprises a lower radial lock mechanism, and wherein the activating sleeve comprises a shoulder and having the lower radial lock mechanism positioned axially between the shoulder and an exit bore, the lower radial lock mechanism preventing movement of the shoulder toward the exit bore until the force threshold is exceeded.

15. The tool string of claim 14, wherein the force threshold is determined at least in part by a flow charactelistic of the fluid.

16. The tool string of claim 15, wherein the flow characteristic is a flow rate of the fluid.

17. A method, comprising:

flowing a fluid through a valve assembly having an activating sleeve that retains a flapper valve in a restrained position while the activating sleeve is maintained in an original position by a locking mechanism;

generating a pressure drop across the activating sleeve while the fluid flows through the valve assembly, wherein the pressure drop is generated by the fluid flows over an inner surface of the activating sleeve comprising an upper ramp and a lower ramp, the fluid flows generating a force on the activating sleeve and the locking mechanism; and advancing the activating sleeve away from the original position when the pressure drop generated by the fluid flows through the activating sleeve generates the force on the activation sleeve and the locking mechanism that exceeds a force threshold, and thereby releasing the flapper valve to move from the restrained position to a released position to cover an entry bore.

18. The method of claim 17, wherein generating a pressure drop further comprises controlling a flow velocity of the fluid flow past the upper ramp and the lower ramp defined on an inner surface of the activating sleeve to control a magnitude of the force on the activating sleeve and the locking mechanism.

19. The method of claim 17, wherein advancing the activating sleeve away from the original position comprises moving a shoulder defined on the activating sleeve past the locking mechanism.

20. The method of claim 17, wherein generating the pressure drop comprises controlling the fluid flows to generate a net force on the activating sleeve that exceeds the force threshold and moves the shoulder of the activating sleeve past the locking mechanism and releasing the flapper valve.

* * * * *